United States Patent [19]

Maurer et al.

[11] 4,403,905

[45] Sep. 13, 1983

[54] OPERATING MECHANISM FOR A SWING MECHANISM VALVE

[75] Inventors: Herman J. Maurer; Carl O. Pedersen, both of Burlington, Iowa

[73] Assignee: J. I. Case Company, Racine, Wis.

[21] Appl. No.: 300,183

[22] Filed: Sep. 8, 1981

Related U.S. Application Data

[63] Continuation-in-part of Ser. No. 180,311, Aug. 22, 1980, Pat. No. 4,341,501.

[51] Int. Cl.[3] ..... E02F 3/32

[52] U.S. Cl. ..... 414/695.5; 414/687; 91/176; 91/210

[58] Field of Search ..... 414/687, 694, 744 R, 414/695.5; 91/176, 188, 210, 411 R

[56] References Cited

U.S. PATENT DOCUMENTS

| | | | |
|---|---|---|---|
| 3,047,171 | 7/1962 | Long | 414/744 R X |
| 3,630,120 | 12/1971 | Carlson et al. | 91/411 R |
| 3,757,642 | 9/1973 | Schuermann | 91/176 |
| 3,872,985 | 3/1975 | Short | 414/694 |
| 4,085,855 | 4/1978 | Worback | 414/694 |
| 4,138,928 | 2/1979 | Pilch | 414/694 X |
| 4,341,501 | 7/1982 | Maurer et al. | 414/694 |

*Primary Examiner*—Robert J. Spar
*Assistant Examiner*—Terrance L. Siemens
*Attorney, Agent, or Firm*—Dressler, Goldsmith, Shore, Sutker & Milnamow, Ltd.

[57] ABSTRACT

An improved hydraulic swing mechanism for a material handling implement, such as a backhoe, includes a multi-position, hydraulic sequencing valve for directing the flow of hydraulic fluid to hydraulic motors which rotate the swing tower and boom of the implement. A unique valve operating mechanism is provided for selectively repositioning the sequencing valve as the boom and swing tower are rotated in order to improve the operating characteristics of the swing mechanism. The valve operating mechanism includes a pivoted, frame mounted actuating arm connected with the sequencing valve by a lost-motion linkage, and flexible linkages connecting the actuating arm with the hydraulic motors of the swing mechanism.

6 Claims, 7 Drawing Figures

FIG. 4b
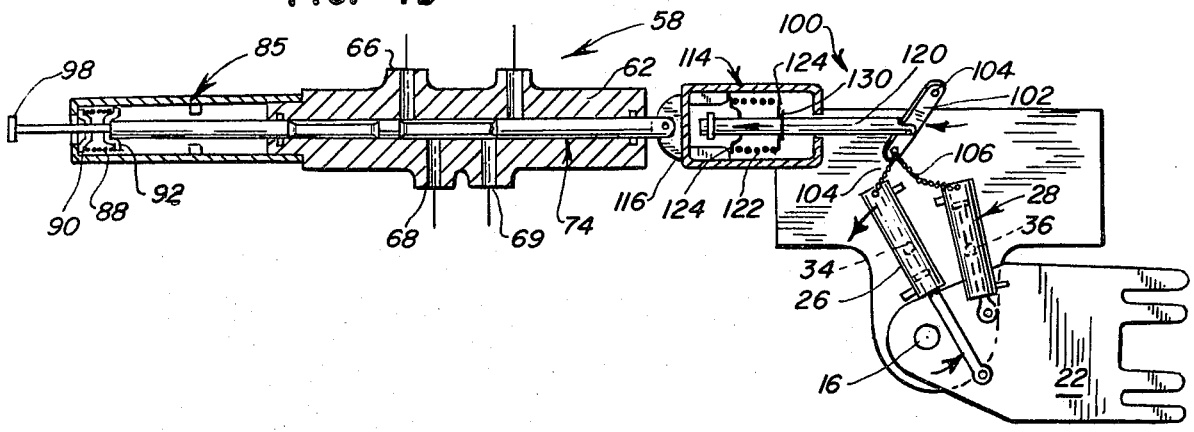
FIG. 5a
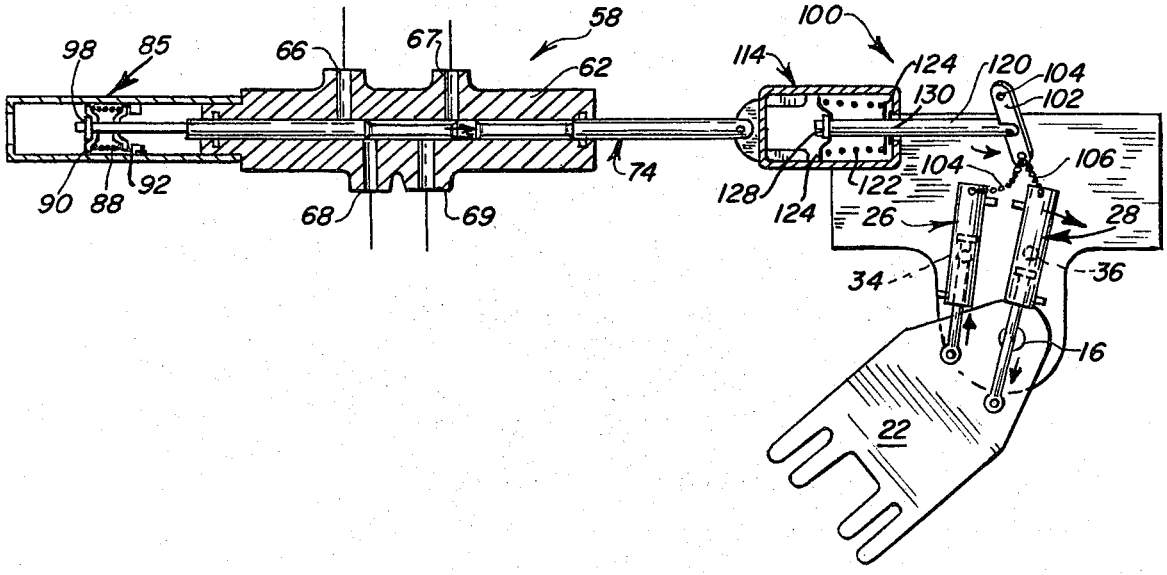
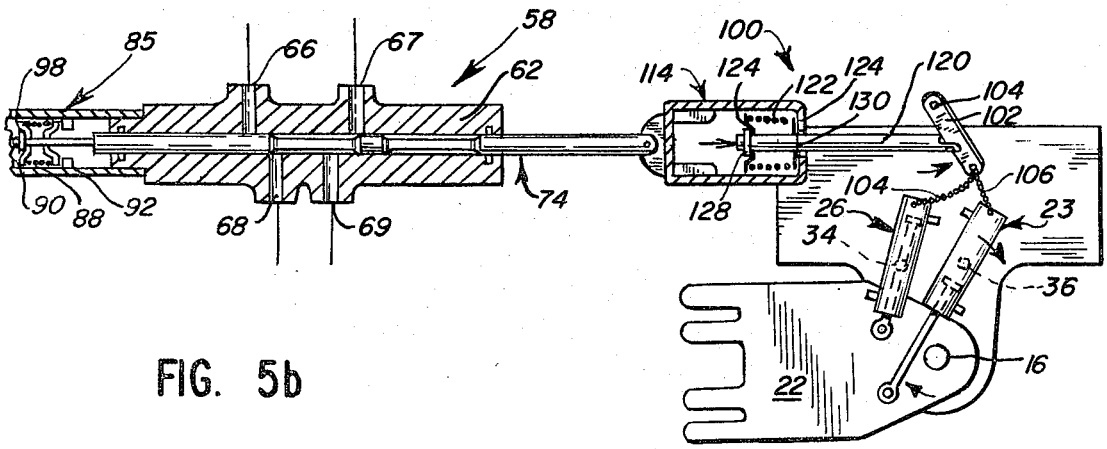
FIG. 5b

OPERATING MECHANISM FOR A SWING MECHANISM VALVE

CROSS-REFERENCE TO RELATED APPLICATION

This is a continuation-in-part of pending U.S. patent application Ser. No. 180,311 filed on Aug. 22, 1980 now U.S. Pat. No. 4,341,501.

TECHNICAL FIELD

This invention relates to the hydraulic swing mechanism used to pivotally rotate a swing tower and boom of an excavator about a vertical axis. In particular, it is related to a new and improved means for controlling the flow of fluid to the double acting hydraulic motors typically used to rotate the swing tower to which the boom is joined.

BACKGROUND OF THE INVENTION

Many implements used in material-handling and in civil engineering applications have members which are pivotally moved by fluid actuated hydraulic motors or fluid rams. The boom support or swing tower carrying the boom and dipper stick of a backhoe is a typical example. There, a pair of hydraulic motors or fluid rams are used to pivot the swing tower with respect to a fixed support frame or stand. The support frame is usually carried at the rear end of a tractor or similar machine. In such a device the hydraulic motors are ordinarily connected to the swing tower on opposite sides of the vertical pivot axis between the swing tower and the fixed support frame. Thus, when the swing tower is rotated, one of the cylinders initially contracts and the other extends in order to rotate the swing tower. Since the arc through which the swing tower rotates is usually at least 180 degrees, one of the hydraulic motors applies the primary force to rotate the boom to one side of its midpoint in the arc of rotation while the other hydraulic motor applies the primary force to rotate the boom in the other direction from the midpoint of the arc of rotation.

Simple as the task may be of rotating the swing tower, this problem has confounded engineers and designers of material handling equipment from the very beginning. If the hydraulic motors could be positioned facing each other on either side of the midplane of rotation, each hydraulic motor would apply an equal force across an equal distance to produce an equal moment arm to torque the swing tower about its vertical axis. Because of the spacial limitations imposed upon designers of material-handling equipment, both hydraulic motors must be positioned generally parallel to one another. Consequently, in the course of rotating the swing tower from one extreme to the other, each hydraulic motor passes through the plane defined by the vertical axis of rotation of the swing tower and the axis of rotation of that element of the hydraulic motor (i.e., cylinder or piston rod) pivotally connected to the fixed frame supporting the swing tower. Thus, two vertical planes are defined having a common intersection at the pivot axis of the swing tower.

When rotating the swing tower from one extreme to the other, one of the hydraulic motors is driven from a fully contracted position to a fully extended position. The fully extended position occurs when the hydraulic motor passes through the plane defined by the frame pivot axis of the hydraulic motor and the vertical axis of rotation of the swing tower. If the swing tower is to continue to rotate, that hydraulic motor must contract in length. When the hydraulic motor passes through this vertical plane the hydraulic motor is said to pass through its "center position," and moves to its "over-center position," as the swing tower and boom approach the end of their arc of rotation.

Many designers have struggled with this problem. The teachings of J. S. Pilch (U.S. Pat. No. 4,138,928) and E. C. Carlson (U.S. Pat. No. 3,630,120) relate the difficulty in converting rectilinear motion to rotational motion. J. S. Pilch and D. L. Worbach (U.S. Pat. No. 4,085,855) are representative of situations where the same inventor has progressed through a series of patents attempting to reach an optimum solution to this problem. An excellent description of the mechanical aspects of the problem is provided by Arthur G. Short in U.S. Pat. No. 3,842,985.

Thus, there is a long-felt need for a hydraulic circuit and operating mechanism which will rotate the swing tower uniformly by the relatively constant application of torque throughout its swing. A simplified, efficient system would be particularly welcomed by the industry.

SUMMARY OF THE INVENTION

In accordance with the present invention a hydraulic circuit and operating mechanism is provided for rotating a movable member through an arc by the conversion of rectilinear motion to rotational motion in such a manner that a relatively uniform torque is applied to the rotational member throughout the swing. Specifically, and with reference to a backhoe application, two extensible hydraulic motors are used to rotate the swing tower or the bracket supporting the boom about a vertical axis. The swing tower is pivoted about a vertical axis on a fixed support stand or frame. The support frame is in turn attached to a tractor. Each hydraulic motor is pivoted at one end to the support frame and at the other end to the swing tower. The hydraulic power supply on the tractor supplies fluid under pressure to actuate the hydraulic motors. A flow control valve directs fluid under pressure to the hydraulic motors to rotate the swing tower. The flow control valve directs pressurized fluid directly to one end of each of the two hydraulic motors and determines the direction of swing.

A multi-position sequencing valve is interposed between the other two ends of the two hydraulic motors and the flow control valve. The sequencing valve selectively re-routes the pressurized fluid from the control valve to the two hydraulic motors in such a manner that a pressure differential is first created across one of the hydraulic motors, and then both of the hydraulic motors, and finally across the other hydraulic motor.

The position of the sequencing valve is shifted by a valve control mechanism as the hydraulic motors pass through their center positions in rotating the swing tower from one extreme position to another. At the beginning of the swing, pressurized fluid is directed to three of the four sides of the two pistons in the two hydraulic motors so that one motor develops its maximum output force while the other motor develops a reduced output force. At the end of the swing, pressurized fluid is directed to only one of the four sides of the two pistons in the two hydraulic motors, so that only one motor develops its maximum output force to rotate the swing tower. The other hydraulic motor is isolated from high pressure fluid. When the swing tower is between the overcenter positions of each motor, pressurized fluid is directed to two of the four sides so that both motors are fully pressurized to rotate the swing tower. Consequently, a relatively uniform torque is applied to the swing tower and the boom throughout their arc of rotation.

In order to provide proper shifting of the position of the sequencing valve, the subject invention includes a valve control mechanism which operatively connects the sequencing valve with the hydraulic motors of the backhoe. The sequencing valve is provided with a self-centering mechanism so that the spool of the valve is normally biased toward a central position. A control actuating arm is pivotally connected to the support frame of the backhoe, and includes a pair of flexible linkages connecting the arm with each of the two hydraulic motors. The actuating arm is connected with one end of the sequencing valve spool through a valve actuating linkage including an overtravel, lost motion mechanism.

The flexible linkages connecting the actuating arm to each of the hydraulic motors are arranged such that the pivoting action of the hydraulic motors relative to the backhoe frame pivots the actuating arm about its mounting to the frame when either of the hydraulic motors passes through its center position to the overcenter configuration. Movement of the actuating arm in this fashion acts to shift the position of the sequencing valve spool thereby redirecting pressurized fluid to the hydraulic motors as described above. Because the range of travel of the spool within the sequencing valve is relatively smaller than the range of travel of the portion of the actuating arm to which the valve actuating linkage is connected, the actuating linkage includes the overtravel mechanism so that the actuating arm may be moved by the flexible linkages through its full range of motion and the spool of the valve correspondingly shifted. In this way, a sequencing valve control mechanism is provided wherein the position of the valve spool is effectively shifted in response to the movement of the hydraulic motors.

Numerous other advantages and features of the present invention will become readily apparent from the following detailed description of the invention and of the one embodiment described therein, from the claims and from the accompanying drawings.

BRIEF DESCRIPTION OF THE SEVERAL VIEWS OF THE DRAWINGS

FIGS. 4*a* and 4*b* show the operation of the sequencing valve and control mechanism of FIG. 2 as one of the hydraulic motors of the backhoe boom swing mechanism shown in FIG. 1 is moved through its center and overcenter positions;

FIGS. 5*a* and 5*b* illustrate the sequencing valve and control mechanism of FIG. 2 as the other hydraulic motor of the backhoe boom swing mechanism shown in FIG. 1 is moved through its center and overcenter position.

DETAILED DESCRIPTION

Figure 1:
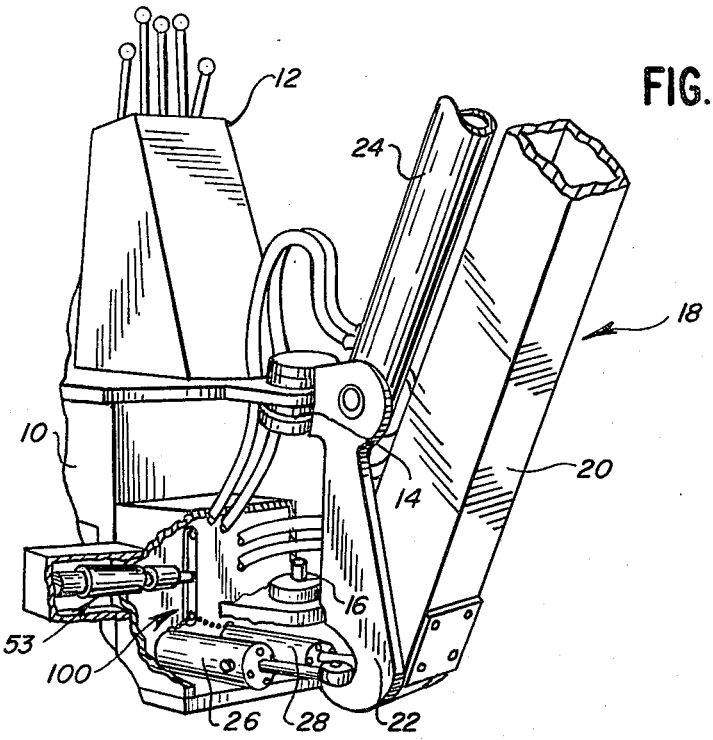
FIG. 1 is a perspective view of a backhoe showing the relative position of the two hydraulic motors used to rotate the backhoe boom about a vertical axis, the hydraulic sequencing valve, and the valve control mechanism of the subject invention.

While this invention is susceptible of embodiment in many different forms, there is shown in the drawings and will herein be described in detail a preferred embodiment of the invention with the understanding that the present disclosure is to be considered as an exemplification of the principles of the invention and is not intended to limit the invention to the specific embodiment illustrated.

OPERATIONAL FUNDAMENTALS

Referring to the drawings, FIG. 1 illustrates a partial view of an implement fixed support frame or stand 10 which is typically mounted on a tractor (not shown). The support frame 10 includes a control station 12 where an operator is stationed to selectively position various control valves to apply hydraulic fluid under pressure to one or more hydraulic motors to operate the various components of the implement to which the support stand 10 is attached. This support frame 10 includes a pair of vertical pivots 14 and 16 on which the implement 18 to be rotated is mounted. For illustrative purposes, the implement 18 is the swing tower 22 and boom 20 of a backhoe; although it should be understood that the present invention is applicable to other implements and other structures and machines such as, for example, articulated steering systems.

In the case of a typical backhoe, the boom 20 is pivotally mounted to boom support or swing tower 22 for movement about a vertical axis. The swing tower 22 is pivotally supported on the two vertical pivots 14 and 16 for lateral rotation.

The boom 20 is raised and lowered by the application of hydraulic pressure to either end of a double acting hydraulic motor or ram 24 and is rotated laterally by the selective application of hydraulic pressure to a pair of double acting, extensible hydraulic motors or fluid rams 26 and 28 pivotally connected at one of their ends to the swing tower 22 on opposite sides of the vertical axis of the vertical pivots 14 and 16. Each hydraulic motor 26, 28 is pivotally connected to the support frame 10.

Each hydraulic motor 26, 28 (as can be seen clearly in FIG. 2) includes a hydraulic cylinder 30, 32 pivotally mounted intermediate its ends at 34, 36 to the support frame 10. The piston rod 38, 40 in each hydraulic motor 26, 28 is pivotally connected to the swing tower 22 by a pin 42, 44. Hydraulic motors mounted in this fashion are sometimes referred to as being center or trunnion mounted.

Figure 3:
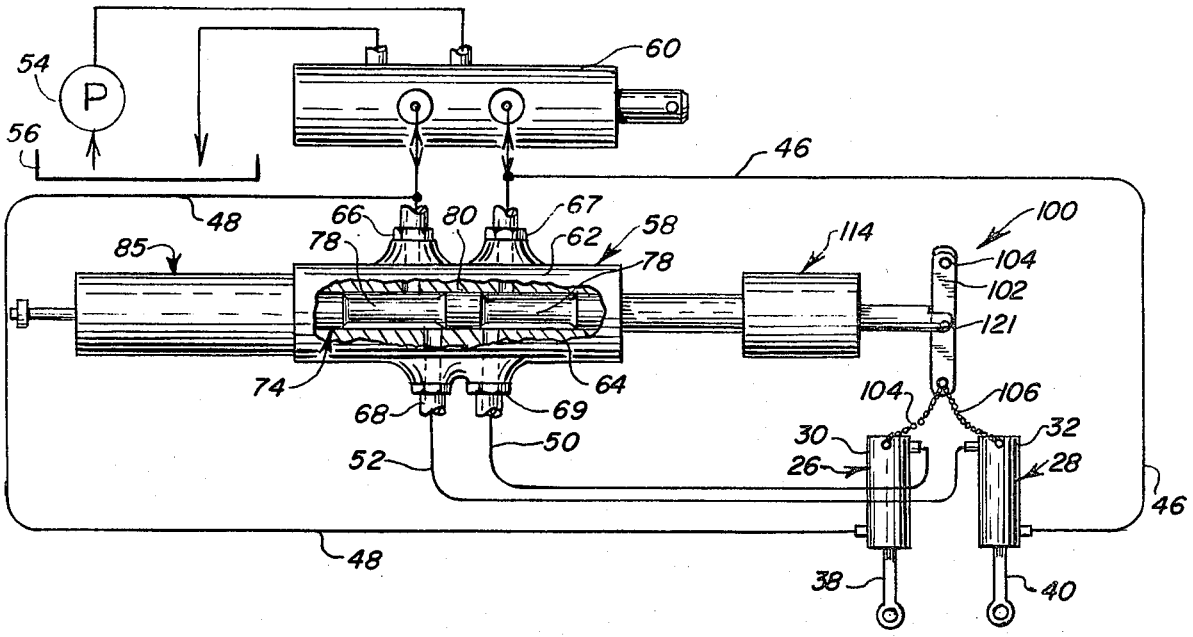
FIG. 3 is a diagrammatic view illustrating the hydraulic circuit of sequencing valve and control mechanism of the subject invention.

The basic hydraulic circuit will now be described. Referring to FIG. 3, hydraulic conduits 46, 48, 50 and 52 are connected to each end of the two hydraulic cylinders 30 and 32 to supply fluid under pressure thereto. In the case of a backhoe mounted on a tractor, the tractor hydraulic system provides the fluid under pressure to actuate the various components of the backhoe. The tractor's hydraulic system typically includes a pump 54 (P) to supply fluid under pressure and a reservoir 56 to collect the fluid displaced by the actuation of the hydraulic motors. A manually actuated valve 60 controls the direction of flow of the pressurized fluid supplied by the pump 54 to the two hydraulic motors 26 and 28. Specifically, the control valve 60 applies fluid under pressure to one of the two hydraulic motors while providing a discharge path from the other hydraulic motor to the reservoir 56.

A sequencing valve 58 is interposed between the other two ends of the two hydraulic cylinders 30 and 32. The position of the sequencing valve 58 is changed by a valve control mechanism 100 in response to the changing lateral position of the boom 20 relative to the fixed support frame 10, as will be described in greater detail below. The sequencing valve 58 has three positions: a right hand position, a center position (shown in FIG. 3), and a left hand position. As each hydraulic motor 26, 28 passes across the pivot axis of the swing tower 22, the control mechanism 100 changes the position of the sequencing valve 58. Further details of the operation of the control valve 60 and the associated hydraulic system is described by Long in U.S. Pat. No. 3,047,171 (assigned to the assignee of the present invention). Those teachings of Long which are not inconsistent with this disclosure and which relate to the operation of the flow control valve 60 and the hydraulic system supplying fluid thereto are incorporated herein by reference.

Figure 2:
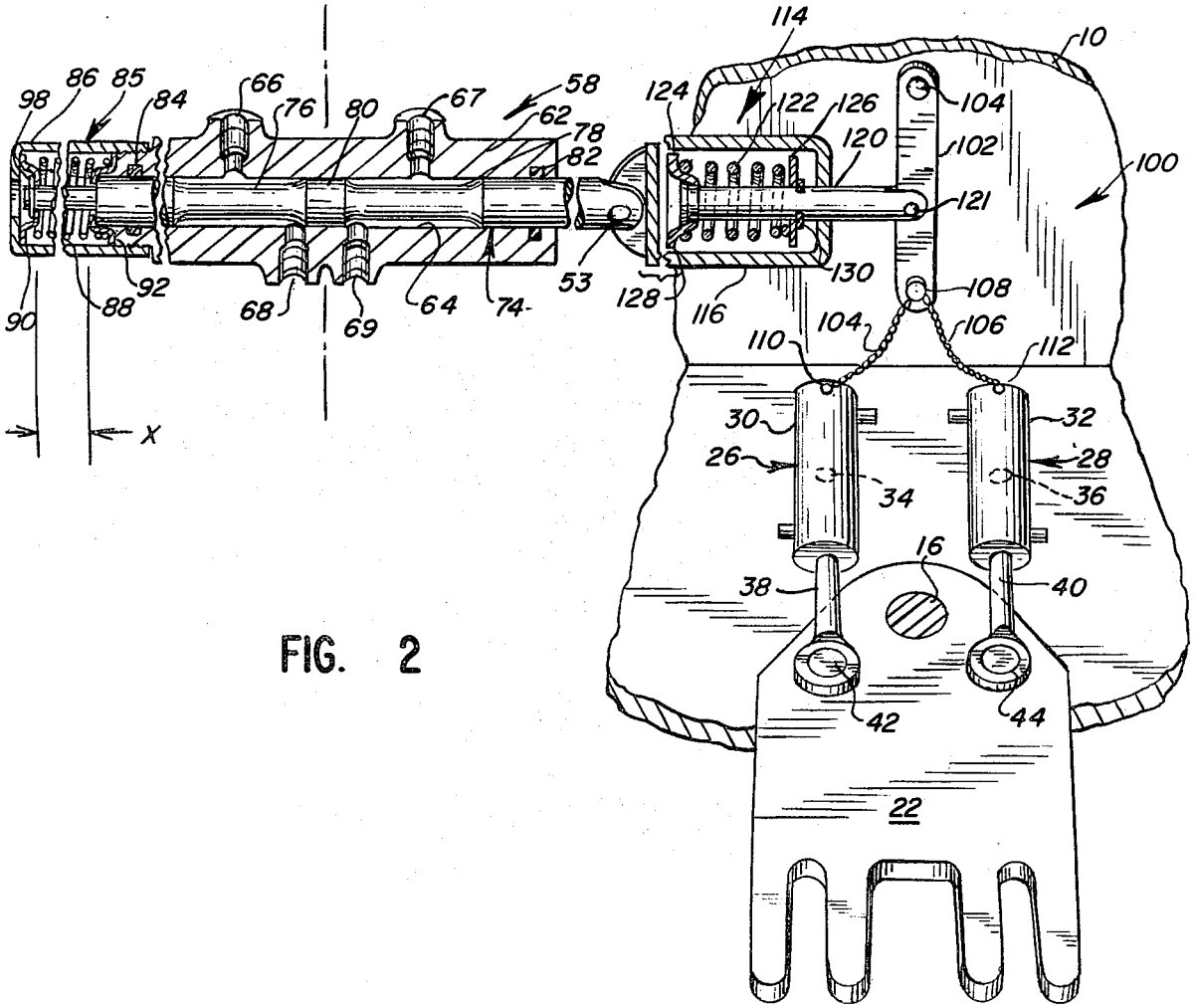
FIG. 2 is a perspective view in partial cutaway illustrating the sequencing valve and control mechanism of the subject invention.

Referring to FIGS. 2, 3, 4*a*, 4*b*, 5*a* and 5*b* it can be seen that when the swing tower 22 is to be moved counterclockwise (as viewed in FIGS. 4*a* and 4*b*) from its center position shown in FIG. 2, hydraulic pressure must be applied to the hydraulic motor 26 and the hydraulic motor 28 to drive the piston rods 38 and 40 outwardly and inwardly, respectively. With hydraulic fluid thus applied (sequencing valve 58 would be in its center position), the boom 20 is rotated counterclockwise in response to the torque supplied by both hydraulic motors 26 and 28 until a point is reached where the moment arm of the hydraulic motor 26 decreases to zero. This point is reached when the piston rod 38 of the hydraulic motor 26 is fully extended and its centerline between its respective pivotal connections crosses the lower vertical pivot 16 of the swing tower 22 (See FIG. 4*a*). This position of the motor 26 is frequently referred to as the "center position," with the motor 26 being in its "over-center position" when it moves beyond this point.

If rotation of the swing tower 22 were to be continued without changing the line up of hydraulic fluid flowing under pressure to the two hydraulic motors 26 and 28, it can be seen from the drawings that the hydraulic pressure that was initially applied to the hydraulic motor 26 would oppose continued counterclockwise rotation of the swing tower 22. In effect, the hydraulic motor 26 would apply a "negative torque" to the swing tower 22 after that motor passes through its center position since the piston rod 38 moves inwardly of the cylinder 30 as the motor 26 goes overcenter. Because the moment arm about which the hydraulic motor 28 reacts is substantially greater than the moment arm of motor 26 after motor 26 has passed through its center position and has gone overcenter, motor 2B would be able to overcome the negative torque created by motor 26 on the swing tower 22, and thus the tower 22 could be moved to the end of its travel, even if the line up of hydraulic fluid were not changed.

Similarly, when the boom 20 is rotated clockwise from its center position (FIG. 2) the hydraulic motors 26 and 28 apply the force to rotate the swing tower 22 with their piston rods 38 and 40 moving inwardly and outwardly, respectively. As motor 28 passes its center position (FIG. 5*a*), the negative torque would be overcome by the relatively greater moment arm of motor 26, assuming no change in the line up of the hydraulic fluid supply. Although the force with which the swing tower 22 is rotated would markedly decrease as the swing tower 22 approached the end of its travel, the increased moment arm of the hydraulic actuator 26 would overcome the opposition of the hydraulic motor 28.

If a plot of the torque applied to the swing tower 22 as a function of the amount of rotation of the swing tower 22 in swinging the boom 20 from the right to the left were drawn, a response curve could be obtained for the hydraulic motors 26 and 28. Such a curve would show that the net applied torque to the swing tower 22 is a variable quantity dependent upon the angular position of the swing tower. Ideally, such a curve should be as "flat" as possible. If this were the case, a relatively "uniform" torque would be applied to the swing tower 22 to rotate the boom 20. The uniform application of torque to the swing tower 22 would rotate the boom at a uniform speed throughout its rotation. Further, if the negative or opposing torque contributions of each hydraulic motor 26, 28 could be removed or negated as the swing tower moved toward the ends of its arc of rotation, a smoother, flatter response curve would result. Mechanically, this characteristic could be obtained by pressurizing only one of the motors 26 and 28 during the last portion of the rotation of the boom 20, after the other of the motors has gone overcenter and the boom 20 and swing tower 22 move toward their travel stop. However, it is precisely at these portions of the travel of the boom 20 and swing tower 22 that the greatest torque should be applied to the swing tower when moving away from the travel stops to overcome its inertia and thereby getting it to move. Thus, it would be desirable for the hydraulic motor in its overcenter condition to provide a supplementary torque for the swing tower in addition to the primary torque being supplied by the other motor. Both of these desired results are achieved by the hydraulic circuit and sequencing valve 58, and value operating mechanism 100 that are the subject of the present invention.

In order to create the above-described operating characteristics, the sequencing valve 58 and valve operating mechansim operate to redirect hydraulic fluid such that as the swing tower 22 and boom 20 move toward the ends of their arc of travel, and one of the hydraulic motors 26 and 28 goes overcenter, one side of the other hydraulic motor only is pressurized, thus relieving the swing tower 22 of the negative torque that would ordinarily be exerted by the overcenter motor (since that motor is unpressurized). When the swing tower 22 and boom 20 are moved away from the ends of their arc of travel while one of the hydraulic motors is overcenter, hydraulic fluid is supplied to one side of the non-overcenter hydraulic motor, and an enhanced or boosted torque is achieved by pressuring both sides of the hydraulic motor which is overcenter. This non-obvious and highly innovative approach to the problem thus presented is very effective since the area of the piston on the cylinder end of each of the hydraulic motors 26 and 28 is greater than the area of the piston on the piston rod side of the hydraulic motors.

The force produced when both sides of one piston are fully pressurized is approximately equal to the cross-sectional area of the piston rod multiplied by the pressure of the high pressure hydraulic fluid.

The hydraulic motor which is overcenter thereby assists the other hydraulic motor in rotating the swing tower instead of creating a negative torque, and without abruptly changing the torque over that situation where only the non-overcenter hydraulic motor is pressurized. Furthermore, since the direction of flow of fluid across the cylinder that is pressurized on one side (the non-overcenter motor) can be changed simply by repositioning the manually actuated control valve 60, the sequencing valve that was used to cut-off high-pressure fluid from the cylinder or head side of the piston in the other hydraulic motor as it went overcenter as the swing tower moved towards its stop, can then be used to pressurize both sides of that hydraulic motor as the tower moves away from its stop. This realization or act of inventive insight greatly simplifies the "valving" needed to redirect the flow of fluid to both hydraulic motors in rotating the swing tower first in one direction and then in the other direction. This will become quite clear from the detailed discussion following.

Recapitulating, in order to flatten the torque characteristic curve and to improve the operator's control of the swing tower when rotating it from one extreme to the other, the sequencing valve: (1) cuts off the flow of pressurized fluid to that hydraulic motor having just passed through its overcenter position as the swing tower moves toward its travel stop; (2) pressurizes both sides of that hydraulic motor which is in its overcenter position and one side of the other hydraulic motor when the swing tower is moved away from its travel stop; and (3) pressurizes opposite sides of the pistons in both hydraulic motors when both hydraulic motors are between their center positions (i.e., at the mid-portion of the arc of rotation).

DETAILS OF OPERATION

The details of the sequencing valve 58 are illustrated in FIG's. 2 and 3. The sequencing valve 58 has two main parts: a valve body 62 and a valve spool 74. The valve body 62 has a generally axial bore 64 extending therethrough with four valve ports 66, 67, 68 and 69 surrounding the bore 64 at points intermediate the two ends of the valve body 62.

Two valve ports 66 and 67 are joined to the same corresponding end of the two hydraulic motors 26 and 28 by conduits 48 and 46, respectively, and the other two valve ports 68 and 69 are joined to the other corresponding ends of the two hydraulic motors by conduits 52 and 50, respectively. In particular, two valve ports 68 and 69 are in flow communication with the cylinder end of the two hydraulic motors 26 and 28 while the other two valve ports 66 and 67 are in flow communication with the piston rod end of the two hydraulic motors 26 and 28.

The valve spool 74 of the sequencing valve 58 has two recessed portions 76 and 78 disposed intermediate its ends. A circumferential land 80 separates the two recessed portions 76, 78. The valve spool 74 is slidably mounted in the bore 64 of the valve body 62. Conventional seals 82 and 84 seal the annular zone between the bore 64 of the valve body 62 and the outside periphery of the valve spool 74 at each end of the valve body. One end of the valve spool 74 has a pivot 53 suitable for use in joining the spool to valve operating mechanism 100 that is used to shift or reposition the valve spool in the valve body 62.

As best shown in FIG. 2, the sequencing valve 58 includes a self-centering mechanism 85 on one end of the valve body 62. The self-centering mechanism 85 includes a generally cylindrical housing 86 which includes an end portion connected with the valve body 62. Mechanism 85 includes a biasing spring 88, typically of helical coil configuration. The biasing spring 88 is held captive between a pair of generally hat-shaped, cup-like elements 90 and 92 which are slidably disposed within the interior of the housing 86. The valve spool 74 of the sequencing valve 58 includes an end portion 94 of reduced diameter which is distinguished from the remainder of the valve spool 74 by a circumferential land 96. The spool end portion 94 extends beyond the valve body 62 of the sequencing valve 58 and projects into the housing 86 of the self-centering mechanism 85. Each of the hat-spaced elements 90 and 92 define holes through which spool end portion 94 extends. A snap ring 98 is affixed to the spool end portion 94 such that it is adapted to abut and engage a portion of the hat-shaped element 90. As shown in FIG. 2, sequencing valve 58 is disposed in its center position. It will be observed that hat-shaped elements 90 and 92 are generally disposed at opposite ends of the housing 86 of the self-centering mechanism 85. The distance between the centrally opposed portions of each of the elements 90 and 92 ("x") represents the permissible travel of the valve spool 74 within the valve body 62 of the sequencing valve 58. The self-centering mechanism 85 acts to urge the valve spool 74 toward this disposition at all times. Thus, if the valve spool 74 is moved to the right of the valve body 62 (with reference to the orientation shown in FIG. 2) snap ring 98 engages element 90 which in turn compresses the spring 88 since it is held captive between the elements 90 and 92. When the centrally opposed portions of elements 90 and 92 abut each other after the valve spool 74 has shifted it to the right, further travel of the valve spool 74 in that direction is prevented. Similarly, if the valve spool 74 is moved to the left of its central position shown in FIG. 2, the circumferential land 96 would engage the element 92, thereby urging it to compress the biasing spring 88 until the opposed portions of element 92 and 90 abut or engage each other. This would represent the extreme left-hand position of the valve spool 74. Clearly, because the biasing spring 88 is maintained in compression whenever the valve spool 74 is shifted to either side of its center position, the spring 88 continually urges the valve spool 74 toward its center position and thus provides a self-centering arrangement for the sequencing valve 58.

In accordance with the subject invention, the valve spool 74 is moved or repositioned within the valve body 62 by a valve control mechanism 100. With reference to FIGS. 1 and 2, control mechanism 100 includes an actuating arm 102 which is pivotally connected to the support frame 10 at pivot 104. In the preferred embodiment, the actuating arm 102 is generally vertically disposed, but it will be understood that the actuating arm 102 could be placed in various dispositions and still provide the proper control function.

The other end of the actuating arm 102 is connected with a pair of flexible linkages 104 and 106, each connected to the actuating arm 102 by a suitable connector at 108. The flexible linkage 104 extends between the actuating arm 102 and hydraulic motor 26, and is attached to the cylinder portion 30 thereof at connection 110. Similarly, flexible linkage 106 extends between the actuating arm 102 and hydraulic motor 28, and is connected with a portion of cylinder 32 thereof at 112. The flexible linkages 104 and 106 may comprise chains, cables, or other suitable means for transmitting tension between the hydraulic motors 26 and 28 and the actuating arm 102.

It should be appreciated that in the position of the actuating arm 102 illustrated in FIG. 2, each of the flexible linkages 104 and 106 is in a non-tensioned condition, with each including some slack. Thus, as the hydraulic motors 26 and 28 are actuated to pivot the swing tower 22 about its pivot axis, each of the hydraulic motors 26 and 28 pivots about its respective pivotal mounting 34, 36 resulting in arcuate movement of the respective connections 110 and 112. If the hydraulic motors were to move the swing tower in a counterclockwise direction, as viewed in FIG. 2, the hydraulic motor 26 would pivot about its pivotal mounting 34 in a counterclockwise direction as well. As it rotated, the slack in flexible linkage 104 would be taken up. When the slack in flexible linkage 104 has been eliminated, the linkage 104 is placed in tension and further pivoting of the hydraulic motor 26 about pivotal mounting 34 results in actuating arm 102 being drawn or pulled and thereby pivoted about its pivotal mounting 104. As this occurs, flexible linkage 106 extending between actuating arm 102 and hydraulic motor 28 would remain in a non-tensioned state, and the amount of slack therein would increase somewhat because of the reorientation of hydraulic motor 28 as swing tower 22 is pivoted about its vertical axis. Similarly, rotation by the hydraulic motors 26 and 28 of the swing tower 22 in a clockwise direction would result in flexible linkage 106 being placed in tension, as hydraulic motor 28 pivots about its pivotal mounting 36 and the slack in linkage 106 is eliminated. This would result in pivotal movement of the actuating arm 102 to the right, when viewed as in FIG. 2.

It should be noted that the preferred embodiment of the subject invention provides that each of the hydraulic motors 26 and 28 is center or trunnion mounted and thus their rotational motion is easily translated to the flexible linkages 104 and 106 by connecting the linkages to a portion of their respective fluid cylinders. However, the subject arrangement would be easily adaptable for use with hydraulic motors mounted in a different fashion. For instance, if each of the hydraulic motors 26 and 28 were of the so-called end mounted variety, each could easily be provided with a suitable apenditure extending rearwardly of their main body portions for connection of flexible linkages 104 and 106 thereto, such that rotation of the motors about their respective pivotal mountings would result in movement for tensioning one of linkages 104 and 106. Similarly, the flexible linkages 104 and 106 could be connectd to different portions of each of the hydraulic motors 26 and 28, but it is preferred that the portions of the motors to which the flexible linkages are connected exhibit a fair degree of motion, accommodating translation of that motion through the flexible linkages to provide pivotal movement of the actuating arm 102.

As will be more fully described hereinafter, the subject invention contemplates repositioning of sequencing valve 58 as either of the hydraulic motors 26 and 28 moves through its respective center position in relation to the pivot axis of the swing tower 22. Thus, linkages 104 and 106, and actuating arm 102 are dimensioned and disposed such that one of the linkages is placed in tension thereby causing the actuating arm 102 to pivot as one of the hydraulic motors 26 and 28 is moved through its center position. However, because it may be desirable for some applications to provide different timing for the repositioning of the sequencing valve 58, or other similar valve mechanism, it will be appreciated that this could be easily accomplished by altering the disposition or dimension of linkages 104 and 106 or actuating arm 102.

With further reference to FIG. 2, actuating arm 102 is operatively connected with the sequencing valve 58 through an overtravel linkage 114. Mechanisms or linkages such as 114 are frequently referred to as "lost motion" devices in that they provide arrangements whereby input motion to the device may be absorbed or "lost" without a corresponding output motion. Linkage 114 includes a generally cylindrical housing 116 which is pivotally connected at 118 at one end thereof to pivot 53 in the valve spool 74 of the sequencing valve 58. Linkage 114 further includes an input rod 120 extending within and from the housing 116. The input rod 120 is pivotally connected to actuating arm 102 intermediate the ends thereof at pivotal connection 121. Disposed within the mechanism housing 116 is a biasing spring 122, which in the preferred embodiment comprises a helical coil spring. The biasing spring 122 is held in captive relation between a generally hat-shaped element 124 and a generally disc-shaped element 126. The input rod 120 extends through each of the elements 126 and 124, such that the biasing spring 122, the input rod 120, and elements 124 and 126 are maintained in generally concentric relation.

The input rod 120 is provided with a snap ring 128 in close proximity to one end thereof, and a snap ring 130 disposed between the element 126 and a respective portion of the housing 116. Thus, it will be appreciated that input into the linkage 114 through the input rod 120 which is sufficient to overcome the biasing force of the spring 120 would cause one of the snap rings 128 and 130 to respectively engage one of the elements 124 and 126 thus resulting in deformation of the spring 122. Specifically, if the actuating arm 102 were moved to the left as viewed in FIG. 2, and input rod 120 placed in compression, this motion would be transmitted through the overtravel linkage 114 to the sequencing valve 58. However, if valve spool 74 of sequencing valve 58 was in a position at that point in time wherein mechanism 114 could not be moved the left, the snap ring 130 provided on the input rod 120 would engage element 126, thereby moving element 126 to the left and compressing spring 122. In effect, the movement of input rod 120 as a result of the pivoting of the actuating arm 102 would be effectively "lost." Similarly, if actuating arm 102 were pivoted to the right as viewed in FIG. 2, and input rod 120 placed in tension snap ring 128 would engage element 124 and displace it to the right thereby compressing the spring 122 so that the motion of the input rod 120 would be lost (assuming, of course, that motion of the sequencing valve 58 to the right was not possible). With this arrangement, spring 122 is disposed such that is resists lost motion, but accommodates it when necessary. The integrated operation of the actuating arm 102, the overtravel mechanism 114, and the sequencing valve 58 will be more fully described hereinafter.

The valve spool 74 has three positions in the valve body 62: "right-hand" position (shown in FIGS. 5*a* and 5*b*), a "center position" (shown in FIGS. 2 and 3), and a "left-hand" position (shown in FIGS. 4*a* and 4*b*). In the center position valve port 66 is in communication with valve port 68, and valve port 67 is in communication with valve port 69. Consequently, when the sequencing valve 58 is in its center position and the flow control valve 60 is actuated, high pressure fluid is applied to two of the four inlet ports in the two hydraulic motors 26, 28 (through conduits 48 and 52, or conduits 46 and 50, depending upon the desired direction of rotation of swing tower 22).

When the sequencing valve 58 is in the right-hand position (see FIGS. 5*a* and 5*b*), high pressure fluid is applied to three conduits (46, 50, 52) of the four conduits to the two hydraulic motors 26 and 28 in rotating the swing tower 22 counterclockwise, and to only one conduit (48) of the four conduits in rotating the swing tower clockwise. In each case, when the sequencing valve 58 is in its right-hand position, three of the four valve ports in the valve body 62 of the sequencing valve 58 are joined together in fluid flow communication (i.e., valve ports 67, 68 and 69).

Similarly, when the sequencing valve is in the left-hand position L.H. (see FIGS. 4*a* and 4*b*) three of the four valve ports in the sequencing valve are joined together, i.e., valve ports 66, 68 and 69. Specifically, the two valve ports 68 and 69 (joined to the cylinder end of each of the two hydraulic motors 26 and 28) are in fluid flow communication with valve port 67 and are consequently joined together with the piston rod end of the hydraulic motor 28 (via conduit 46). In particular, when the swing tower 22 is rotated counterclockwise, the two cylinder ends of the two hydraulic motors 26 and 28 and the piston end of hydraulic motor 26 are joined to the low pressure side of the flow control valve 60 (via conduits 50, 52 and 48, respectively), while high pressure fluid is supplied to the piston end of hydraulic motor 28 (through conduit 46). In rotating the swing tower 22 clockwise, the cylinder ends of the two hydraulic motors 26 and 28 and the piston end of motor 28 are joined to the high pressure side of the flow control valve 60.

It will be observed from the foregoing that when the sequencing valve 58 is in its center position (see FIG'S, 2 and 3) hydraulic fluid is applied under pressure to opposite sides of the two hydraulic motors 26 and 28. In other words, one of the two hydraulic motors is ported so as to drive its piston rod outwardly while the other hydraulic motor is ported to drive its piston rod inwardly. In addition, when the sequencing valve 58 is either in the right-hand or left-hand position, one of the two hydraulic motors 26 and 28 (the one having just passed through its center position and going overcenter as the swing tower 22 moves towards one of the ends of its arc of rotation) is isolated from the high pressure side of the hydraulic control valve 60 if the rotation of the swing tower is continued in a direction toward the end of the travel of the swing tower. That hydraulic motor then does not oppose the torque produced by the other hydraulic motor. However, if the rotation of the swing tower is reversed (i.e., the position of the flow control valve 60 is changed), both sides of the piston of that hydraulic motor (which is overcenter) are pressurized. When so pressurized that hydraulic motor boosts or assists the other hydraulic motor in rotating the swing tower away from the end of the arc of travel of swing tower 22.

The integrated operation of sequencing valve 58 and the valve operating mechanism 100 will now be described. As shown in FIG. 2, the valve spool 74 of the sequencing valve 58 is shown in its center position, and the actuating arm 102 of the valve control mechanism 100 is shown in a center position with each of the flexible linkages 104 and 106 being in a slack condition.

Figure 4A:
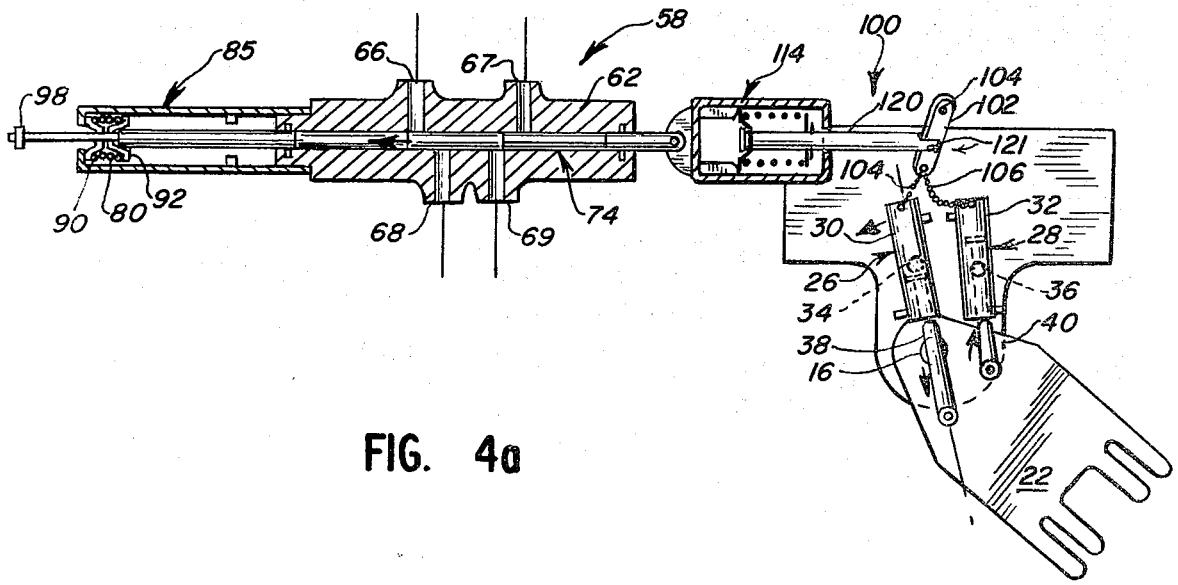

With reference now to FIGS. 4*a* and 4*b*, the operation of the swing mechanism for the swing tower 22 will be described as swing tower 22 is rotated in a counterclockwise direction by hydraulic motors 26 and 28 from the position shown in FIG. 2. Flow control valve 60 has been manipulated by the vehicle operator such that high pressure fluid is being directed to the cylinder end of hydraulic motor 26 and the piston end of hydraulic motor 28. As the swing tower 22 is rotated from the position illustrated in FIG. 2 to the position illustrated in FIG. 4*a*, hydraulic motor 26 pivots about its pivotal mounting 34 which acts to take up the slack in flexible linkage 104. As the hydraulic motor 26 moves through its center position (shown in FIG. 4*a*) the flexible linkage 104 has been placed in tension causing actuating arm 102 to be pivoted about its pivotal mounting 104. It will be observed that flexible linkage 106 is maintained in a non-tensioned or slack condition as hydraulic motor 28 pivots about its pivotal mounting 36. As the hydraulic motor 26 moves through its center position thereby pulling actuating arm 102, arm 102 acts through overtravel linkage 114 to shift valve spool 74 of the sequencing valve 58 to its left-hand position (shown in FIG. 4*a*). Because the spring 122 within the overtravel linkage 114 is more stiff (i.e., has a greater force/deflection spring rate) than the spring 88 within the self-centering mechanism 85 of the sequencing valve 58, the overtravel linkage 114 acts as a solid link between the actuating arm 102 and the valve spool 74 the spring 122 resisting lost motion. As the valve spool 74, is driven to the left of the valve body 62 of the sequencing valve 58, circumferential land 96 engages the hat-shaped element 92 within the self-centering mechanism 85, and urges the element 92 such that spring 88 is compressed. As the valve spool 74 is moved into its left-hand position, the centrally opposed portions of elements 92 and 90 within the self-centering mechanism 85 engage each other thus preventing further movement to the left of the valve spool 74 within the valve body 62. In this position as shown in FIG. 4*a*, the sequencing valve 58 would place valve ports 66, 68 and 69 in fluid flow communication and thus connect both sides of hydraulic motor 26 and the cylinder end of motor 28 to the low pressure side of the hydraulic system (via conduits 48, 50 and 52), while the piston end of hydraulic motor 28 would be connected to the high pressure side of the hydraulic system (via conduit 46). This, hydraulic motor 28 acts upon the swing tower 22 to induce rotation thereof.

As the swing tower 22 is further rotated to the position shown in FIG. 4*b*, actuating arm 102 is further pivoted about pivot 104 by motor 26 and flexible linkage 104, but valve spool 74 is prevented from further axial displacement within the valve body 62. To accommodate this, the overtravel linkage 114 absorbs the additional motion of the actuating arm 102 in that input rod 120 acts through snap ring 130 and element 126 to compress the spring 122 of the overtravel linkage. In this way, the actuating arm 102 may move or pivot through its full range of motion while valve spool 74 of the sequencing valve 58 is maintained in its left-hand position, and hydraulic motor 28 moves the swing tower 22 toward the end of its arc of travel.

When the swing tower 22 is moved away from its extreme position illustrated in FIG. 4*b*, and rotated in a clockwise direction the change in the position of control valve 60 redirects the flow of hydraulic fluid through the sequencing valve 58 such that high pressure fluid is directed (via conduits 48, 50 and 52) to both sides of hydraulic motor 26, and cylinder end of hydraulic motor 28. As discussed, this portion provides additional torque for overcoming inertial forces in moving the swing tower 22 and the boom 20 when they are moved from the extreme position shown in FIG. 46, since both hydraulic motors produce a positive torque on the swing tower 22.

As the swing tower 22 is rotated from the position illustrated in FIG. 4*b* to the position illustrated in FIG. 4*a*, the overtravel linkage 114 is returned to its original disposition wherein spring 122 extends to its original length. The extension of spring 122 acts through link 120 to pivot actuating arm 102 toward its original disposition since the pivoting of hydraulic motor 26 permits flexible linkage 104 to move toward it's non-tensioned original configuration. As the swing tower 22 continues to rotate in a clockwise direction and hydraulic motor 26 goes from its overcenter position through its center position, the tension within flexible linkage 104 is decreased, thus permitting spring 88 of the self-centering mechanism 85 to return the valve spool 74 to its center position. Thus, it will be appreciated that the integrated operation of sequencing valve 58 and valve operating mechanism 100 provides smooth, efficient and automatic rerouting of hydraulic fluid within the hydraulic system in order to provide improved swinging operation of the boom 20.

When the boom 20 and the swing tower 22 are further rotated in a clockwise direction from the position illustrated in FIG. 2, the sequencing valve 58 and the valve operating mechanism 100 would operate in a similar fashion to provide efficient redirection of hydraulic fluid. As the swing tower 22 rotates to the position shown in FIG. 5*a*, flexible linkage 106 is placed in tension by the movement of hydraulic motor 28 (through its center position) about its pivotal mounting 36, causing the actuating arm 102 to be pivoted about its mounting 104. Pivotal movement of actuating arm 102 is translated through the overtravel linkage 114 to the valve spool 74, whereby the valve spool 74 is shifted within the valve body 62 toward its right-hand position.

As the valve spool 74 is moved within the valve body 62, the snap ring 98 on the end portion 94 of the valve spool 74 engages element 90 of the self-centering mechanism 85 causing it to move into engagement with the corresponding element 92 as spring 88 is compressed. When the opposed portions of elements 90 and 92 engage each other, the valve spool 74 is in its right-hand position and further movement of the valve spool 74 is prevented, as illustrated in FIG. 5*a*. This shifting of the valve spool 74 within the sequencing valve 58 would result in valve ports 67, 68 and 69 being in fluid communication, and thus conduits 46, 50 and 52 connected with the low pressure side of the hydraulic system. High pressure hydraulic fluid is directed through conduit 48 to the piston end of hydraulic motor 26, which provides primary force for the continued rotation of the swing tower 22 and the boom 20 toward the end of their arc of rotation.

As the swing tower 22 continues to rotate in a clockwise direction, hydraulic motor 28 is moved into an overcenter disposition as the swing tower 22 is moved toward the end of its travel. This continued rotation causes the hydraulic motor 28 to continue to draw flexible linkage 106 as the motor 28 pivots about its mounting 36. This continued movement causes actuating arm 102 to pivot about its mounting 104, and to further displace the overtravel linkage 114. Because the valve spool 74 of the sequencing valve 58 is in its right-hand position, and is prevented from further movement to the right, the continued motion of the actuating arm 102 is effectively absorbed or "lost" by the overtravel linkage 114. The snap ring 128 affixed to the input rod 120 engages element 124 of the overtravel linkage, causing spring 122 to be compressed. In this way, actuating arm 102 may freely move through its free range of motion, while valve spool 74 is maintained in its right-hand position. This condition is illustrated in FIG. 5*b*. As noted, spring 122 of the overtravel linkage 114 is more stiff than spring 88 of the self-centering mechanism 85, thus providing the proper repositioning of the sequencing valve 58 before the movement of the actuating arm 102 is absorbed or lost by the overtravel linkage 114.

When the boom 20 in swing tower 22 are to be rotated in a counterclockwise direction from the position illustrated in FIG. 5*b* (i.e., away from their travel stop), the operator would reposition control valve 60 which would direct hydraulic fluid to sequencing valve 58 (in its right-hand position) such that high pressure hydraulic fluid is routed through conduits 46, 50 and 52, while conduit 48 is connected with the low pressure side of the hydraulic system. The effect of this would be to pressurize the cylinder end of hydraulic motor 26 thereby providing the primary force for rotating the swing tower, and to pressurize both ends of the hydraulic motor 28 for providing additional torque for rotating the swing tower 22 away from this extreme position. As the swing tower continues to rotate in a counterclockwise direction and moves through the position illustrated in FIG. 5*a*, the tension in flexible linkage 106 is lessened such that spring 122 of the overtravel linkage 114 expands to its original disposition. As the swing tower continues to rotate, and hydraulic motor 28 moves through its center position (FIG. 5*a*) the continued decrease in tension in the flexible linkage 106 permits the spring 88 of the self-centering mechanism 85 to expand thereby causing valve spool 74 to shift back to its center position wherein valve ports 66 and 68, and valve ports 67 and 69 are in fluid communication. Thus, high pressure fluid would be directed to the cylinder end of hydraulic motor 26 through conduit 50, and the piston rod end of hydraulic motor 28 through conduit 46.

It should be observed from the foregoing that the sequencing valve 58 and valve operating mechanism 100 are extremely simple in construction and do not require complex machining or otherwise high tolerance hydraulic components. Furthermore, since the flow control valve 60 and the two hydraulic motors 26 and 28 are normally employed in the operation of a backhoe, the sequencing valve 58 and operating mechanism 100 can be added to an existing hydraulic system with a minimum amount of difficulty and without extensive changes to the conduit and hydraulic hoses joining together the various components. The fact that the torque characteristic curve of the swing control mechanism has been improved with such a relatively minor modification should prove to enhance its acceptance by the industry and lead to its employment in swing mechanisms on both backhoes and other articulated vehicles.

Those skilled in the art will appreciate from the foregoing description that the hydraulic circuit and operating mechanism just described offers many advantages over hydraulic circuits now in use. Specifically:

(1) The torque characteristic curve is smoother and flatter. In other words, there is less variation from the maximum applied torque to the minimum applied torque;

(2) More torque is available to rotate the swing tower at either end of the arc of rotation;

(3) Relatively speaking, the angular velocity of the boom is slower at the two extreme ends of rotation. This makes cushioning easier and reduces the impact of the swing tower or the boom running into the mechanical stops;

(4) Since the negative torque contribution at either end of the swing is eliminated, more torque is available at either end to give a quicker start, that is, there is less hesitation in driving the boom from one extreme to the other;

(5) Because the torque output at the two extreme ends of the swing is increased over prior designs, the boom can be more easily swung in an uphill direction when the tractor is inclined at an angle or tilted relative to a horizontal plane;

(6) The cost of the hydraulic circuit is much less than other known designs; and (7) A single sequencing valve is used to control the flow to both hydraulic motors.

Thus, it is apparent that there has been provided in accordance with this invention a novel device for controlling the rotation of the swing mechanism of a backhoe or other similar machines. While the invention has been described with respect to one specific embodiment, it should be appreciated that the principles of the invention can be applied to many other devices employing hydraulic motors to convert rectilinear motion to a rotation. Once the basic principle of the invention is understood, it will be realized that there are many alternatives, modifications and variations that will be apparent to those skilled in the art in light of the foregoing description. Accordingly, it is intended to cover all alternatives, modifications, and variations as set forth within the spirit and broad scope of the following claims.

What is claimed is:

1. An improved hydraulic swing mechanism for a material handling implement having a frame, a swing tower pivotally supported by said frame for rotation about a vertical axis through an arc, and a boom supported by said swing tower, comprising:

first and second hydraulic motors each having one end pivotally connected to said frame and another end pivotally connected to said swing tower, each motor being extensible whereby extension and contraction of said motors pivot said swing tower relative to said frame, control valve means operable by the implement operator to selectively supply pressurized hydraulic fluid in said first and second hydraulic motors for selectively rotating said swing tower relative to said frame, sequencing valve means in fluid communication with said control valve means and said first and second hydraulic motors for selectively re-routing pressurized hydraulic fluid supplied from said control valve means to said first and second hydraulic motors, said sequencing valve means having a plurality of operating positions, and valve operating means including an arm means pivotally connected to said frame and connected with each of said first and second hydraulic motors for pivotal movement of said arm means in response to pivoting of said motors with respect to said frame, and further including first and second flexible linkage means respectively connecting said arm means with said first and second hydraulic motor means whereby tensioning of one of said first and second flexible linkage means by pivoting movement of its respective hydraulic motor pivots said arm means, and linkage means connecting said arm means to said sequencing valve means for selectively repositioning said sequencing valve means by pivotal movement of said arm means.

2. The improved hydraulic swing mechanism of claim 1, said linkage means comprising lost motion means whereby said arm means is pivotal while said sequencing valve means is maintained in one of its positions.

3. The improved hydraulic swing mechanism of claim 2, said lost motion means comprising a housing connected with said sequencing valve means, a rigid link pivotally connected with said actuating arm means and extending therefrom within said housing a pair of elements slidably disposed within said housing on said rigid link, said rigid link including means abutting respective opposite sides of said elements, and a first biasing spring held captive between said elements and urging said elements toward respective opposite ends of said housing.

4. An improved valve operating mechanism for a material handling implement, such as a backhoe, having a frame, a swing tower and a boom mounted to said frame for pivotal movement about a vertical axis through an arc, and a hydraulic swing mechanism for pivoting said swing tower and boom including a pair of hydraulic motors each having one end pivotally connected to said frame and another end pivotally connected to said swing tower whereby extension and contraction of said motors pivots said swing tower and boom, and a multi-position hydraulic sequencing valve for directing flow of hydraulic fluid to said motors, comprising:

an actuating arm pivotally mounted to said frame for pivotal movement with respect thereto, first and second flexible linkage means each extending between and respectively connected with said actuating arm and one of said motors, for pivoting said arm during pivoting of said swing tower by said motors through respective end portions of its pivotal arc, and lost-motion linkage means connecting said actuating arm with said sequencing valve whereby pivotal movement of said actuating arm selectively repositions said sequencing valve for redirecting flow of hydraulic fluid to said motors.

5. An improved hydraulic swing mechanism for a material handling implement having a frame, a swing tower pivotally supported by said swing tower, comprising:

first and second hydraulic motors each having one end pivotally connected to said frame and another end pivotally connected to said swing tower, each motor being extensible whereby extension and contraction of said motors pivot said swing tower relative to said frame, control valve means operable by the implement operator to selectively supply pressurized hydraulic fluid to said first and second hydraulic motors for selectively rotating said swing tower relative to said frame, sequencing valve means in fluid communication with said control valve means and said first and second hydraulic motors for selectively re-routing pressurized hydraulic fluid supplied from said control valve means to said first and second hydraulic motors, said sequencing valve means comprising a three position spool valve having a valve spool slidably disposed within an axial bore defined by a valve body, said valve spool being slidable between a center position and left-hand and right-hand positions on opposite sides of said center position, and said sequencing valve means including a self-centering mechanism including a second biasing spring for urging said valve spool to its center position, and valve operating means including arm means pivotally connected to said frame and connected with each of said first and second hydraulic motors for pivotal movement of said arm means in response to pivoting of said motors with respect to said frame, and linkage means connecting said arm means to said sequencing valve means for selectively repositioning said sequencing valve means by pivotal movement of said arm means, and comprising lost motion means whereby said arm means is pivotal without repositioning said sequencing valve means and includes a first biasing spring means resisting lost motion, the force/deflection rate of said first biasing spring means being greater than the force/deflection rate of said second biasing spring.

6. An improved hydraulic swing mechanism for a material handling implement having a frame, a swing tower pivotally supported by said frame for rotation about a vertical axis thorugh an arc, and a boom supported by said swing tower, comprising:

first and second hydraulic motors each having one end pivotally connected to said frame and another end pivotally connected to said swing tower, each of said first and second hydraulic motors respectively include first and second cylinders and first and second piston rods including pistons slidably disposed within said cylinders whereby selective fluid pressurization of opposite cylinder and rod ends of each hydraulic motor pivots said swing tower relative to said frame, control valve means operable by the implement operator to selectively supply pressurized hydraulic fluid to said first and second hydraulic motors for selectively rotating said swing tower relative to said frame, sequencing valve means in fluid communication with said control valve means and said first and second hydraulic motors for selectively re-routing pressurized hydraulic fluid supplied from said control valve means to said first and second hydraulic motors, said sequencing valve means comprising a three position spool valve having a valve spool slidably disposed within an axial bore defined by a valve body, said valve spool being slidable between a center position and left-hand and right-hand positions on opposite sides of said center position, said spool valve being in fluid communication with said cylinder and rod ends of each of said first and second hydraulic motors such that respective opposite ends of said first and second hydraulic motors are in fluid communication when said valve spool is in said center position, both of said cylinder and rod ends of said first motor and said cylinder end of said second motor are in fluid communication when said spool is in the left-hand position, and both of said cylinder and rod ends of said second motor and said cylinder end of said first motor are in fluid communication when said spool is in said right-hand position, and said sequencing valve means including a self-centering mechanism urging said valve spool to its center position within said valve body, and valve operating means including arm means pivotally connected to said frame and connected with each of said first and second hydraulic motors for pivotal movement of said arm means in response to pivoting of said motors with respect to said frame, and linkage means connecting said arm means to said sequencing valve means for selectively repositioning said sequencing valve means by pivotal movement of said arm means.

* * * * *